US008152574B2

(12) United States Patent
Matsuoka et al.

(10) Patent No.: US 8,152,574 B2
(45) Date of Patent: Apr. 10, 2012

(54) CONNECTOR FOR USE WITH APPARATUS

(75) Inventors: Hiroyuki Matsuoka, Yokkaichi (JP); Katsuhide Kitagawa, Seto (JP)

(73) Assignees: Sumitomo Wiring Systems, Ltd. (JP); Toyota Jidosha Kabushiki Kaisha (JP)

( * ) Notice: Subject to any disclaimer, the term of this patent is extended or adjusted under 35 U.S.C. 154(b) by 0 days.

(21) Appl. No.: 12/741,098

(22) PCT Filed: Nov. 4, 2008

(86) PCT No.: PCT/JP2008/070010

§ 371 (c)(1),
(2), (4) Date: Jun. 14, 2010

(87) PCT Pub. No.: WO2009/060812

PCT Pub. Date: May 14, 2009

(65) Prior Publication Data

US 2010/0255728 A1 Oct. 7, 2010

(30) Foreign Application Priority Data

Nov. 9, 2007 (JP) ..... 2007-292308

(51) Int. Cl.
*H01R 4/30* (2006.01)

(52) U.S. Cl. ..... 439/801; 439/587; 439/607.27

(58) Field of Classification Search ..... 439/801, 439/587, 588, 910, 607.27
See application file for complete search history.

(56) References Cited

U.S. PATENT DOCUMENTS

| | | | | |
|---|---|---|---|---|
| 5,733,153 | A * | 3/1998 | Takahashi et al. | 439/801 |
| 6,142,805 | A * | 11/2000 | Gray et al. | 439/206 |
| 6,837,728 | B2 | 1/2005 | Miyazaki et al. | |
| 6,905,375 | B2 * | 6/2005 | Ikeda | 439/801 |
| 7,083,471 | B2 * | 8/2006 | Hayashi | 439/607.53 |

FOREIGN PATENT DOCUMENTS

| | | |
|---|---|---|
| JP | 2000-048912 | 2/2000 |
| JP | 2003-197037 | 7/2003 |
| JP | 2004-328932 | 11/2004 |
| JP | 2006-031962 | 2/2006 |

* cited by examiner

*Primary Examiner* — Hien Vu
(74) *Attorney, Agent, or Firm* — Gerald E. Hespos; Michael J. Porco

(57) ABSTRACT

Upon fitting of the first housing 10 and the second housing 50, joints 21, 63 of the two terminals 20, 60 are superposed in the fitting portion 11, the two joints 21, 63 having respective bolt-insertion holes 21A, 63A that allow for insertion of a bolt V thereinto so that the two joints 21, 63 are fixed together. The fitting portion 11 of the two housings 10 has an operation hole 23 that allows for bolting of the two terminals 20, 60. A first shield shell 40 is attached to the first housing 10. The first shield shell 40 is fixable to the case. A second shield shell 70 is attached to the second housing 50. The second shield shell 70 in a fitted state of the two housings 10, 50 is slidable between: a position to expose the operation hole 23 to the outside; and a position to cover the operation hole 23 and to cooperate with the first shield shell 40 to cover the fitting portion 11.

9 Claims, 16 Drawing Sheets

CONNECTOR FOR USE WITH APPARATUS

BACKGROUND OF THE INVENTION

1. Field of the Invention

The present invention relates to a connector for use with apparatus. The connector supplies electric power to an apparatus accommodated in a metal case.

2. Description of the Related Art

A connector described in Japanese Unexamined Patent Application Publication No. 2006-31962 is one of a known connector for use with apparatus and for supplying electric power to an apparatus (such as a motor) accommodated in a metal case. The connector includes a first housing and a second housing. The first housing can be attached to an attachment hole that extends through the case in an in-out direction. The second housing can be attached to a terminal portion of an electric wire. The two housings can be fitted together.

The first housing holds a first terminal. The first terminal is elongated in a fitting direction of the two housings. The first terminal has two longitudinal end portions. One of the end portions having a bolt hole is disposed on an apparatus side and is bolt-connected to an apparatus-side terminal. The other end portion protrudes in a fitting direction with the second housing and is connected to a second terminal held in the second housing.

The second terminal has a square-tubular portion in the front side in a fitting direction with the first housing. Accompanying fitting of the two housings, the protruding end portion of the first terminal enters the square-tubular portion of the second terminal and elastically contacts an elastic contact piece in the square-tubular portion so that the two terminals are connected together.

With the above-explained structure, the first terminal and the apparatus-side terminal are firmly bolt connected, so that the connection reliability has been improved. However, such firm connection has not been realized between the first terminal and the second terminal. Accordingly, further improvement in the connection reliability has been required.

The present invention was completed on a basis of circumstances as explained above, and its purpose is to provide a connector for use with apparatus and capable of improving the connection reliability.

SUMMARY OF THE INVENTION

The present invention is a connector for use with apparatus and to be connected to a terminal of an apparatus accommodated in a metal case. The connector includes: a first housing that holds a first terminal that is bolt-connectable to the terminal of the apparatus; and a second housing that holds a second terminal to be fastened to a terminal portion of an electric wire and is capable of being fitted with the first housing. The first terminal and the second terminal are connectable together. Upon fitting of the first housing and the second housing, joints of the two terminals are superposed in the fitting portion. The two joints have respective bolt-insertion holes that allow for insertion of a bolt thereinto so that the two joints are fixed together. The fitting portion of the two housings has an operation hole that allows for bolting of the two joints. A first shield shell is attached to the first housing. The first shield shell is fixable to the case. A second shield shell is attached to the second housing. The second shield shell in a fitted state of the two housings is slidable between: a position to expose the operation hole to the outside; and a position to cover the operation hole and to cooperate with the first shield shell to cover the fitting portion of the two housings.

Such a configuration makes it possible to: bolt up the bolt-insertion holes of the first terminal and the second terminal superposed in the fitting portion of the two housings while holding the second shield shell at the position to expose the operation hole; and, thereafter, slide the second shield shell to the position to cover the operation hole and fix the second shield shell to the first shield shell. Thus, in addition to firm connection between the apparatus-side terminal and the first terminal, film connection between the first terminal and the second terminal can be realized. Accordingly, connection reliability can be improved.

Furthermore, the connector may be configured as follows: the first shield shell is disposed rearwardly relative to the fitting portion of the first housing with the second housing in a fitting direction with the second housing and protrudes substantially perpendicularly to the fitting direction from a circumference of the fitting portion; and the second shield shell slides in a fitting direction of the two housings, the second shield shell having a front end portion in the fitting direction, the front end portion being contactable with the first shield shell.

The connector also may be configured as follows: the case has a screw hole for screw-fixing the first shield shell; the first shield shell has an area corresponding to the screw hole of the case, the area having a first screw-insertion hole; and a screw inserted in the first screw-insertion hole is tightened into the screw hole of the case so that the first shield shell is fixed to the case.

The connector also may be configured as follows: the second shield shell has a second screw-insertion hole that is superposed on the screw hole of the case and on the first screw-insertion hole; and a screw inserted in the first screw-insertion hole and in the second screw-insertion hole is tightened up into the screw hole of the case so that the first shield shell and the second shield shell are fixed to the case. This makes it possible to fix the first shield shell and the second shield shell with the single screw.

The connector also may be configured as follows: the second shield shell has a second screw-insertion hole that allows for insertion of a screw thereinto, the screw being for fixing the second shield shell to the first shield shell; and the first shield shell has an area corresponding to the second insertion hole, the area having a screw-up portion wherein the screw is tightened and fixed. This makes it possible to locate the second screw-insertion hole of the second shield shell anywhere regardless of the location of the screw hole of the case.

The connector also may be configured as follows: the second housing and the second shield shell have respective guides, wherein the guides are engaged together to guide the sliding of the second shield shell.

The connector also may be configured as follows: the joint of the first terminal and the joint of the second terminal extend in the fitting direction of the two housings; and at least one of the bolt-insertion hole of the first terminal and the bolt-insertion hole of the second terminal is elongated in the fitting direction of the two housings. By this, even in a case of misalignment of the first and second terminals relative to each other, the bolt-insertion holes can be superposed insofar as the misalignment is within a range for a longitudinal dimension of the bolt-insertion hole. The two terminals can thus be reliably bolted.

The connector also may be configured as follows: the operation hole is capable of being covered by a cap; and the cap includes a seal ring that intimately contacts a peripheral face of the operation hole to seal the gap between the operation hole. By this, upon covering of the operation hole by the cap, the seal ring seals the gap between the cap and the operation hole. This prevents water from entering through the operation hole.

The connector also may be configured as follows: one of the cap and the fitting portion has an engagement piece; the other one of the cap and the fitting portion has an engagement protrusion; and upon covering of the operation hole by the cap, the engagement piece and the engagement protrusion are engaged together to hold the cap in an attached state.

EFFECT OF THE INVENTION

The present invention provides the connector for use with apparatus and capable of improving the connection reliability.

DETAILED DESCRIPTION OF THE PREFERRED EMBODIMENTS

<First Embodiment>

Figure 1:
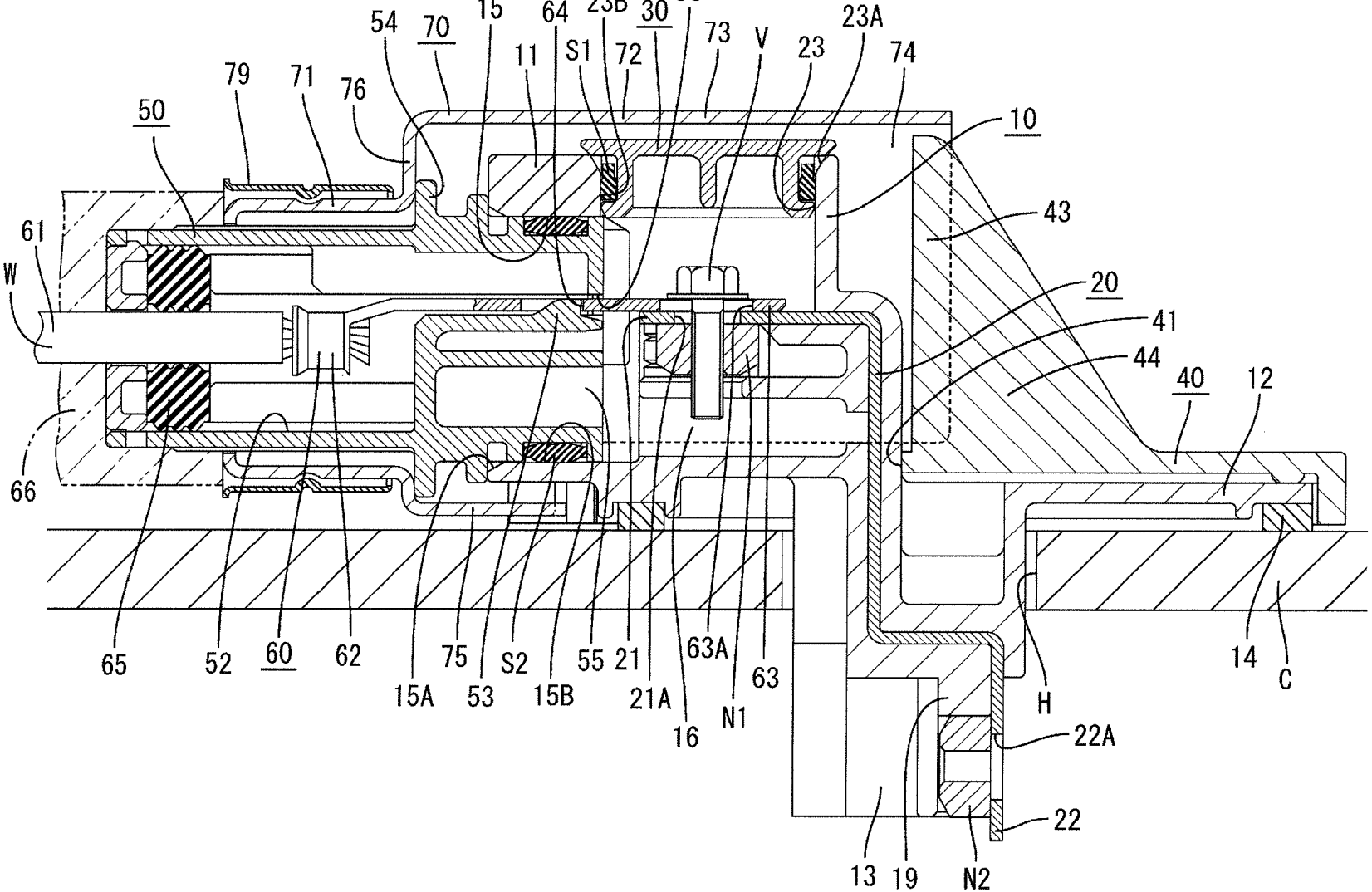
FIG. 1 is a side sectional view illustrating a fitted state of two housings of a first embodiment.
Figure 2:
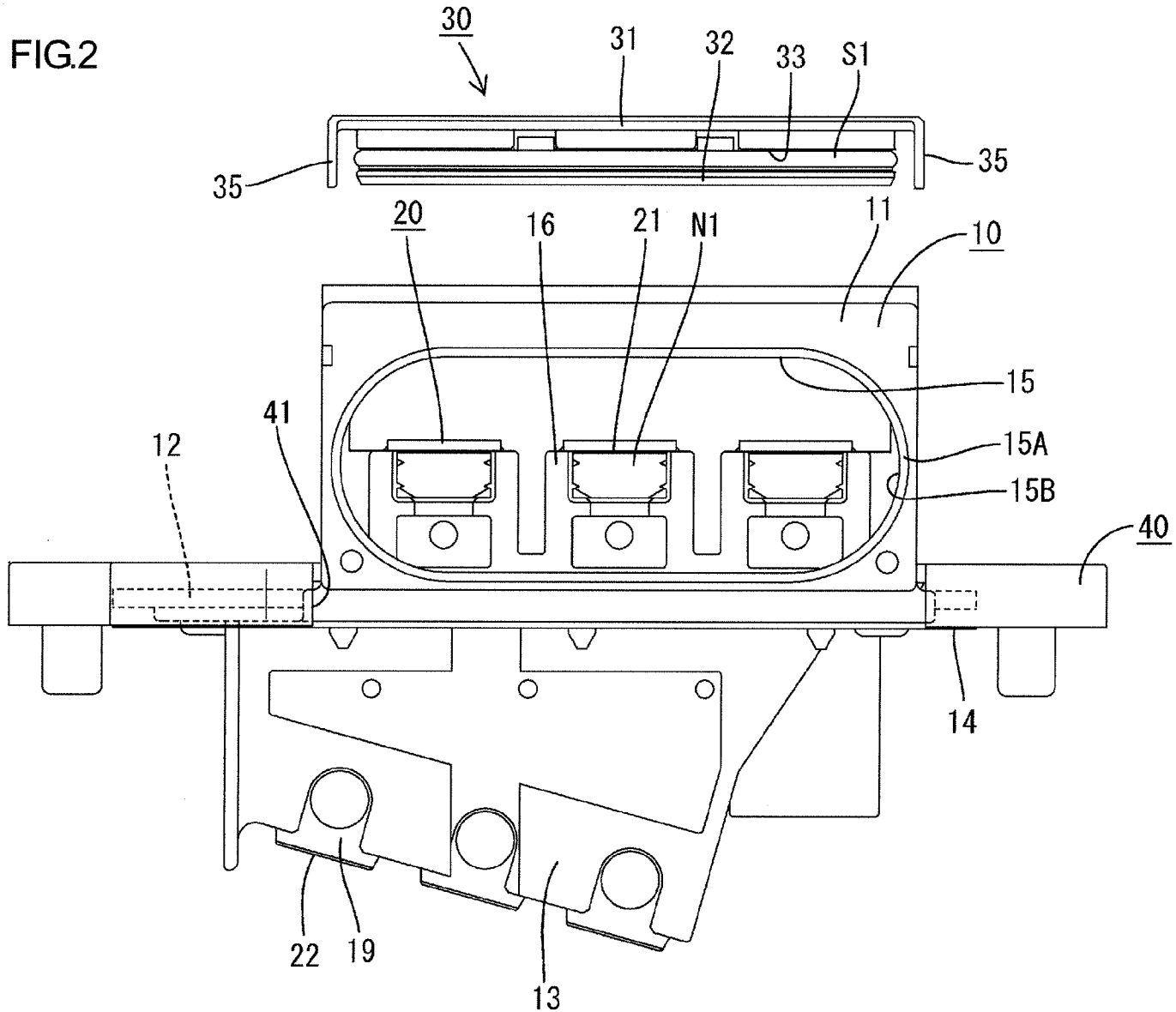
FIG. 2 is a front view of a first housing with a first shield shell attached thereto.

A first embodiment will hereinafter be explained with reference to FIGS. 1 through 9.

A connector for use with apparatus of this embodiment is for supplying electric power to apparatus (for example, a motor, an inverter, etc. that are mounted in a hybrid car etc.) (not illustrated in the drawings). The connector includes a first housing 10 and a second housing 50 that can be fitted with, and separated from, each other. Portions of each component will hereinafter be designated as follows: the portion nearer the fitting face of the two housings 10, 50 as the front; the top in FIG. 2 as the top; and the bottom in the same figure as the bottom. The apparatus is accommodated in a case C. The case C is made of metal and has a shielding function. The case C has an attachment hole H. The attachment hole H extends between the outer face and the inner face of the case C.

The first housing 10, which is made of synthetic resin, includes a first fitting portion 11 (corresponding to a fitting portion with the second housing of the present invention), a flange 12, and an apparatus-side fitting portion 13. The first fitting portion 11 is laterally elongated and is substantially rectangular parallelepiped. The flange 12 extends in a plate-like fashion laterally and rearward from a bottom end portion of the first fitting portion 11. The apparatus-side fitting portion 13 protrudes downward from a bottom face of the flange 12. The apparatus-side fitting portion 13 is disposed rearwardly relative to the first fitting portion 11.

The first housing 10 is attached to the attachment hole H of the case C with the first fitting portion 11 protruded outside the case C and with the apparatus-side fitting portion 13 accommodated inside the case C. The flange 12 is disposed along the outer face of the case C then.

The first fitting portion 11 has a substantially box-like shape with an inner hollow. A front wall of the first fitting portion 11 has a fitting opening 15. The fitting opening 15 allows for fitting of a second fitting portion 55 of the second housing 50 (explained below) thereinto from the front. The fitting opening 15 is laterally elongated and substantially oval and extends in the back-and-forth direction. The inner space of the first fitting portion 11 is opened frontward by the fitting opening 15. The fitting opening 15 has a peripheral face having a circumferential front end. This front end is a fitting tapered face 15A. The fitting tapered face 15A is sloped so that the opening dimension is larger in the front. Furthermore, the peripheral face of the fitting opening 15 has a portion behind the fitting tapered face 15A. This portion is a fitting seal face 15B. The fitting seal face 15B is even. The fitting seal face 15B defines an opening that is uniform in a back-and-forth direction.

The first fitting portion 11 has three wire-side bases 16 laterally arranged therein. Each wire-side base 16 accommodates a nut N1. The axis of the nut N1 is oriented in the up-down direction. A top face of the nut N1 is flush with a top face of the wire-side bases 16.

Two lateral side faces of the first fitting portion 11 has respective engagement protrusions 18. Each engagement protrusion 18 protrudes laterally from the lateral side face of the first fitting portion 11. The engagement protrusion 18 has a top face and a bottom face. The top face is a run-up face 18A having a protruding dimension gradually larger toward the bottom. The bottom face is an engagement face 18B. The engagement face 18B is steep, or perpendicular, with respect to the side face of the first fitting portion 11.

The apparatus-side fitting portion 13 has laterally arranged three apparatus-side bases 19. The distance between an end apparatus-side base 19 in the lateral arrangement and the flange 12 is greater than the distance between the other end apparatus-side base 19 in the lateral arrangement and the flange 12. The middle apparatus-side base 19 is disposed rearwardly relative to the other apparatus-side bases 19. Each apparatus-side base 19 accommodates a nut N2. In the apparatus-side base 19, the axis of the nut N2 is oriented in a back-and-forth direction. The back face of the nut N2 is flush with the back face of the apparatus-side base 19.

The first housing 10 holds three first terminals 20. Each first terminal 20 is bent so as to extend from the wire-side base 16 to the apparatus-side base 19. The first terminal 20 includes a first joint 21 and an apparatus-side joint 22. The first joint 21 is placed along the top face of the wire-side base 16. The apparatus-side joint 22 is placed along the back face of the apparatus-side base 19. The first terminals 20 are insert-molded in the first housing 10 to form a unit. Each first joint 21 is superposed on the top face of the wire-side base 16 and extends frontward.

The first joint 21 and the apparatus-side joint 22 of each first terminal 20 have a first bolt-insertion hole 21A and an apparatus-side bolt-insertion hole 22A, respectively. The first bolt-insertion hole 21A is disposed coaxially with the nut N1 disposed in the wire-side base 16. The apparatus-side bolt-insertion hole 22A is disposed coaxially with the nut N2 disposed in the apparatus-side base 19. The bolt-insertion holes 21A, 22A are substantially circular and are slightly larger than the center holes of the respective nuts N1, N2.

The apparatus-side joint 22 is superposed on the apparatus-side base 19. An apparatus-side terminal (not illustrated in the drawings) connected to the apparatus is superposed on a back face of the apparatus-side joint 22. A bolt (not illustrated in the figure) is inserted in a bolt hole of the apparatus-side terminal and in the apparatus-side bolt-insertion hole 22A of the apparatus-side joint 22, and is tightened in the nut N2. The apparatus-side joint 22 and the apparatus-side terminal are thus conductively connected.

Figure 3:
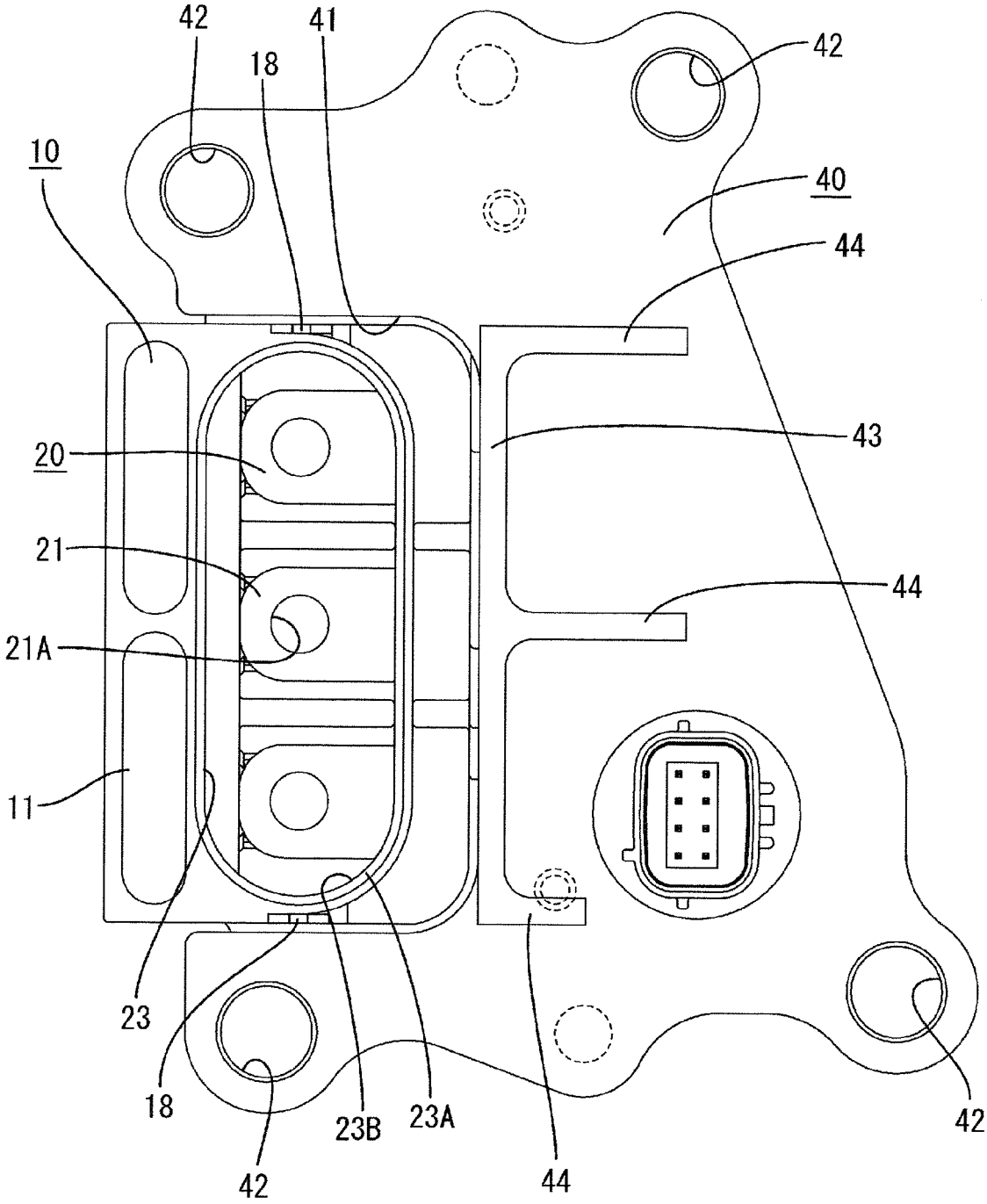
FIG. 3 is a plan view of the same.
Figure 4:
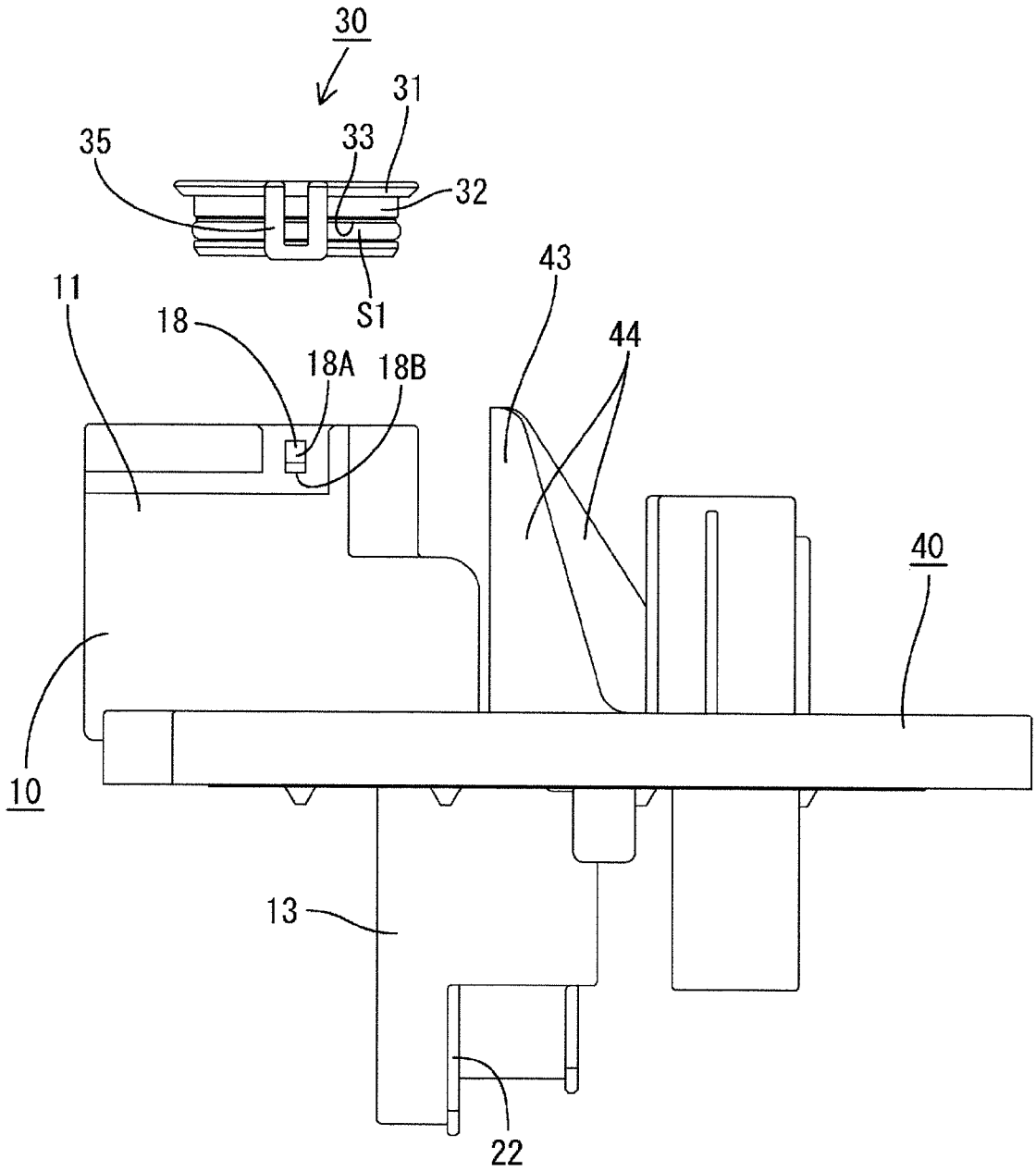
FIG. 4 is a side view of the same.
Figure 5:
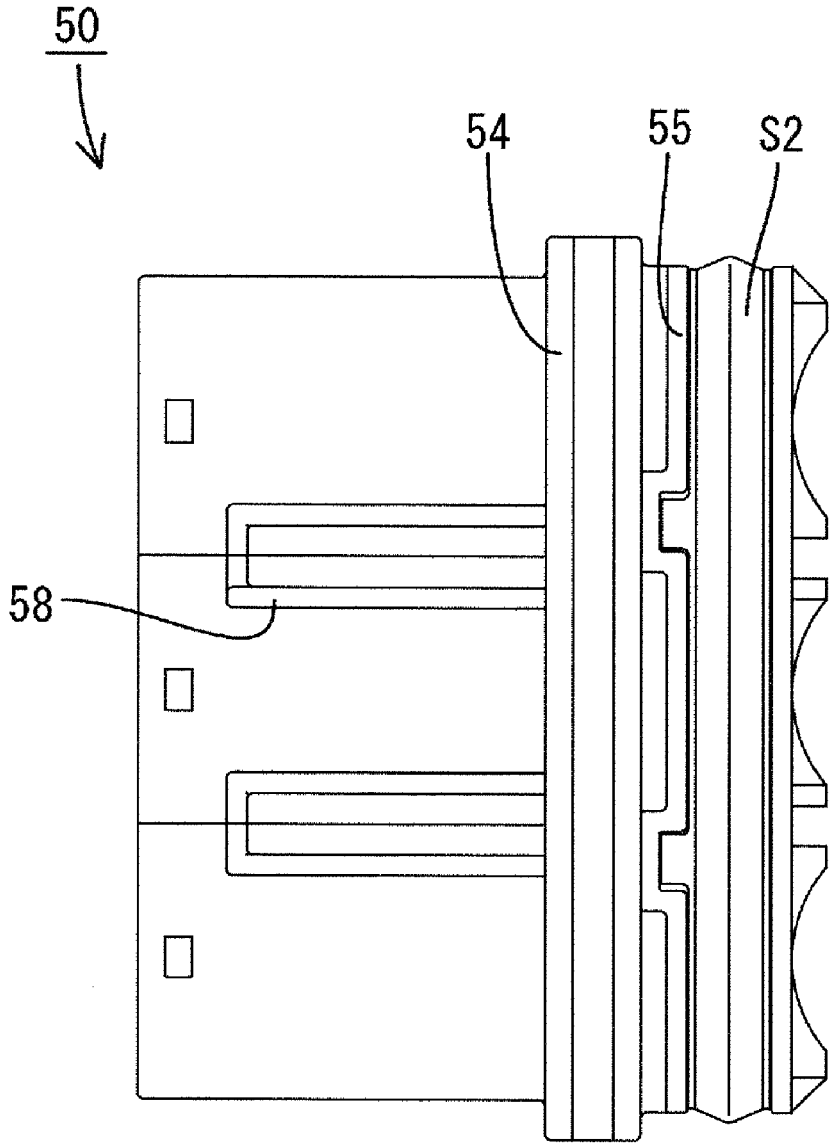
FIG. 5 is a plan view of a second housing before accommodating second terminals.
Figure 6:
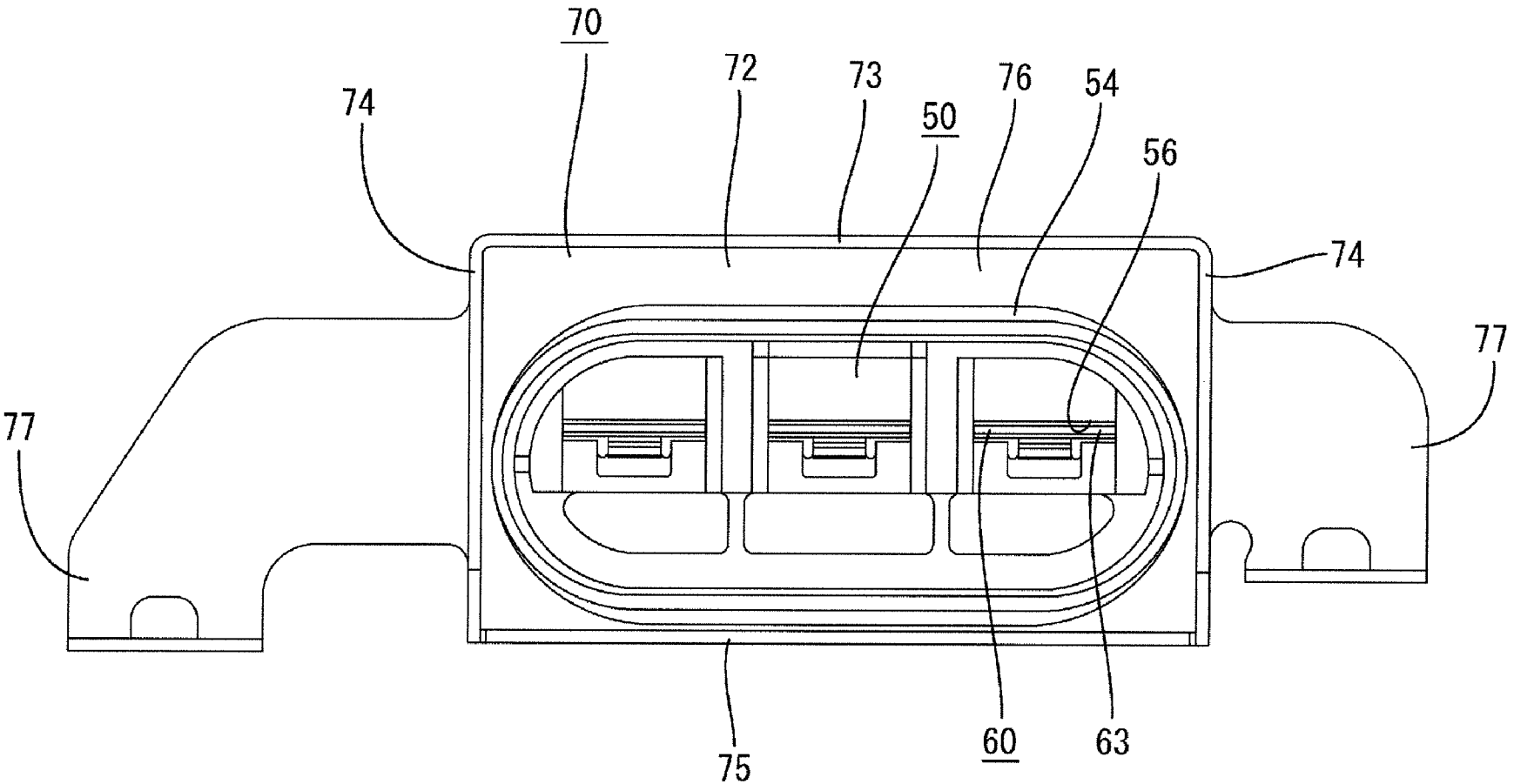
FIG. 6 is a front view of the second housing with a second shield shell attached thereto.
Figure 7:
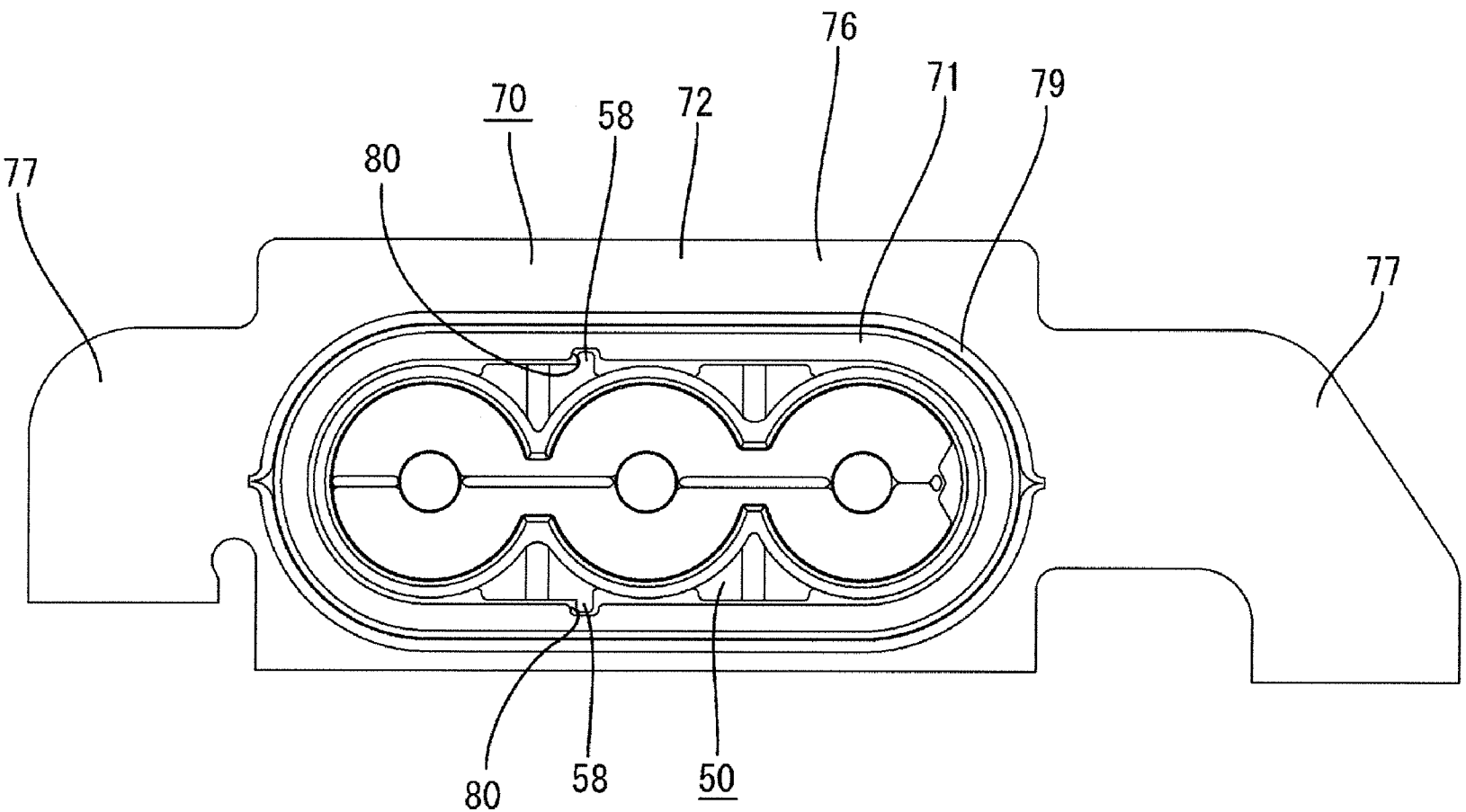
FIG. 7 is a rear view of the same.
Figure 8:
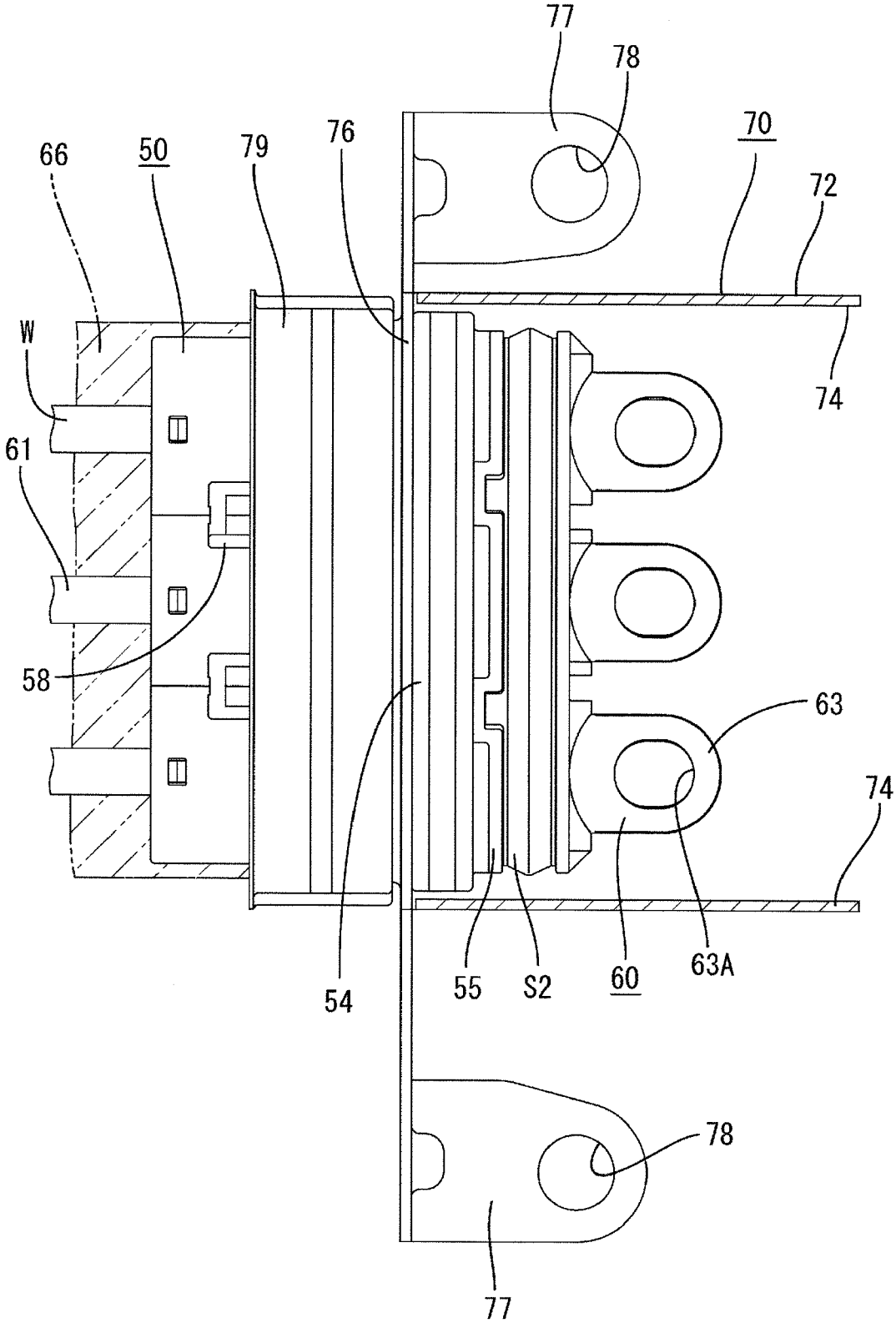
FIG. 8 is a plan sectional view of the same.
Figure 9:
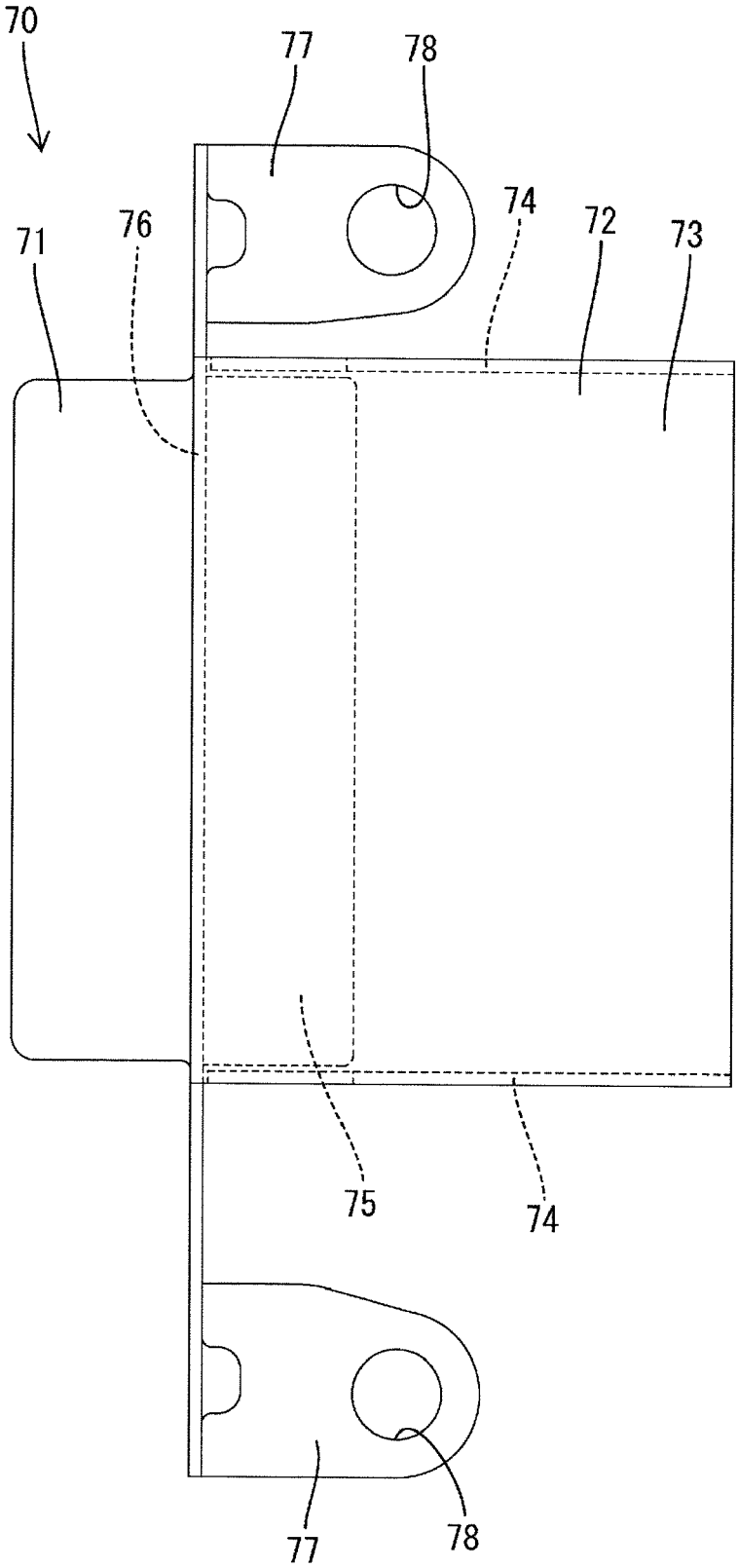
FIG. 9 is a plan view of the second shield shell.
Figure 10:
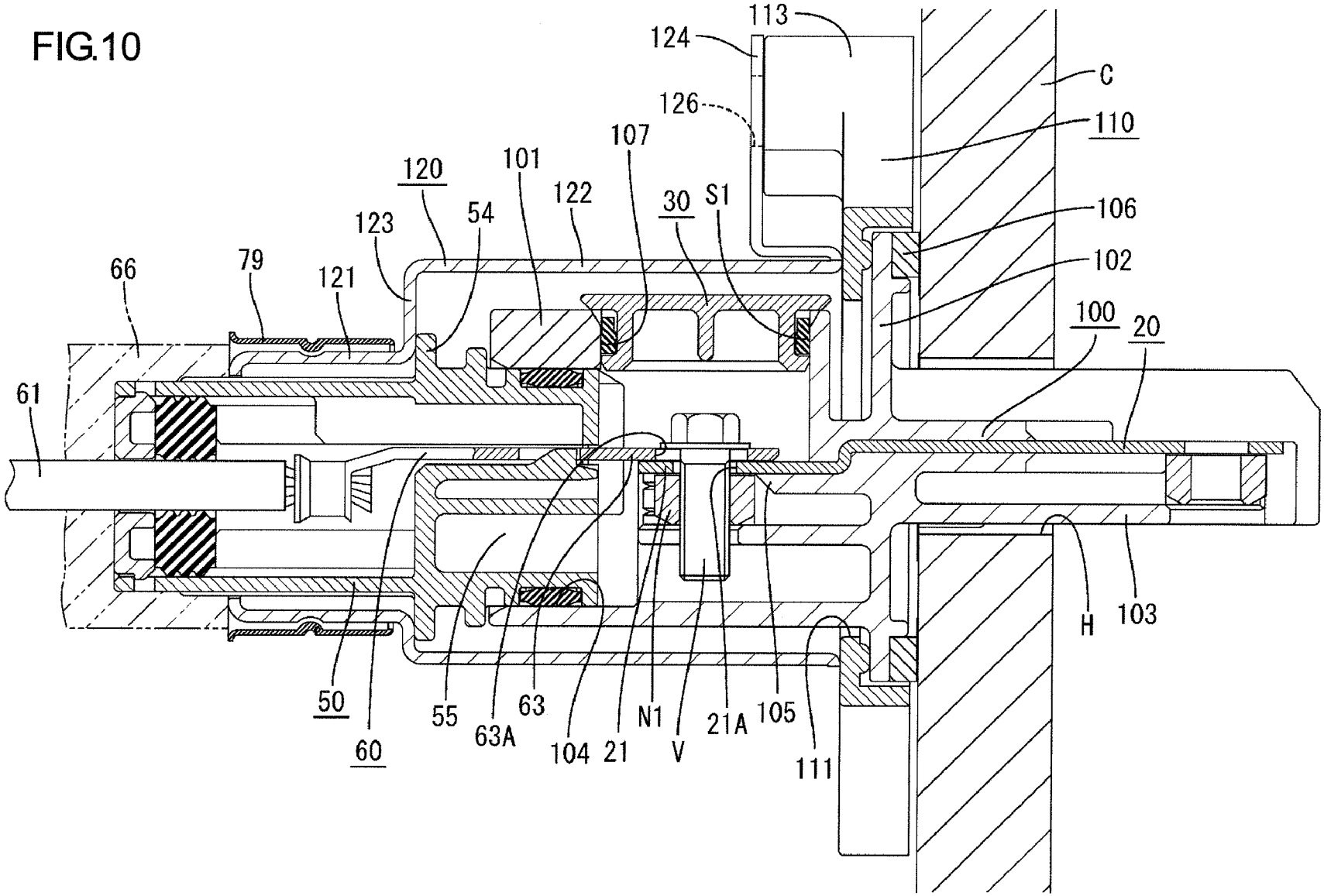
FIG. 10 is a side sectional view illustrating a fitted state of two housings of a second embodiment.

A top wall of the first fitting portion 11 has an operation hole 23. The operation hole 23 is disposed right above the wire-side bases 16. The top wall is opened in an up-down direction by the operation hole 23. The three wire-side bases 16 are exposed via the operation hole 23 to an area above the first fitting portion 11. As illustrated in FIG. 3, the operation hole 23 is laterally elongated and substantially oval. The longitudinal dimension of the operation hole 23 is equal to a dimension between the two end first joints 21 (of the first terminals 20) with extra lateral dimensions from the two end first joints 21. The transverse dimension of the operation hole 23 is equal to a dimension from the front and the rear of the nut N1 (in the wire-side base 16) with extra dimensions from the front of the nut N1 and from the rear of the nut N1.

Furthermore, the operation hole 23 has a peripheral face having a top circumferential end. This top circumferential end is a tapered face 23A. The tapered face 23A is sloped so that the opening dimension is larger in the top. The peripheral face of the operation hole 23 further has a portion under the tapered face 23A. This portion is a seal face 23B. The seal face 23B is even. The seal face 23B defines a uniform opening in the up-down direction.

The first housing 10 includes a cap 30 to stop up the operation hole 23. The cap 30 includes a lid 31 and a stopper 32. The lid 31 is laterally elongated, substantially oval, and slightly larger than the operation hole 23. The profile of the stopper 32 is substantially identical with the profile of the seal face 23B of the operation hole 23. The stopper 32 protrudes from a bottom face of the lid 31. The stopper 32 has a concave and circumferential attachment groove 33 in an outer peripheral face thereof. A seal ring S1 is seated in the attachment groove 33. Upon covering of the operation hole 23 by the cap 30, the seal ring S1 intimately contacts the seal face 23B of the operation hole 23 to seal the gap between the operation hole 23 and the cap 30. This prevents water from entering through the operation hole 23 into the first fitting portion 11.

The cap 30 has engagement pieces 35. The engagement pieces 35 can be engaged with the engagement protrusions 18 of the first fitting portion 11. The engagement pieces 35 are disposed at two ends of the lid 31. The engagement pieces 35 hang downward from the lid 31 in a cantilever fashion. The engagement pieces 35 can elastically deform in the longitudinal direction of the lid 31.

A first shield shell 40 is attached to the flange 12 of the first housing 10 (on the rear side of the first housing 10 in the fitting direction with the second housing 50). The first shield shell 40 is made by aluminium die-casting. The first shield shell 40 is substantially rectangularly notched along the profile of the first fitting portion 11. This notched portion is a recess 41. The first shield shell 40 thus covers a top face and a peripheral face of the flange 12.

The first shield shell 40 has a back wall 43 as an integral part thereof. The back wall 43 stands upward from a rear edge of the recess 41. The back wall 43 is laterally elongated, substantially rectangular, and a little larger than a back face of the first fitting portion 11. The back wall 43 thus covers the back of the first fitting portion 11. Note that a back face of the back wall 43 has three reinforcement plates 44 as integral parts thereof.

The first shield shell 40 has first screw-insertion holes 42 in four corners thereof (in areas corresponding to screw holes (not illustrated in the drawings) of the case C). The first screw-insertion holes 42 are superposed on the screw holes of the case C and are screwed up, and thus the first shield shell 40 is conductively fixed to the case C. The flange 12 of the first housing 10 is then held between an outer face of the case C and the first shield shell 40, and a seal member 14 seated on a bottom face of the flange intimately contacts the outer face of the case C. Thus, a gap between a peripheral edge portion of the attachment hole H of the case C and the first housing 10 is sealed.

The second housing 50 is made of synthetic resin. The second housing 50 has three cavities 52 laterally arranged therein. The cavities 52 can accommodate second terminals 60 fixed to terminal portions of wires 61. The cavities 52 can accommodate the respective second terminal 60 from the rear. The cavities 52 have respective lances 53 on the front-end portions thereof. The lances 53 are engaged with the second terminal 60, and thus the second terminal 60 is prevented from slipping out.

The second housing 50 has an outer peripheral face having a circumferential area a little off-center frontward in the back-and-forth direction. The second housing 50 has a circumferential forward-stop wall 54 in this area. The forward-stop wall 54 protrudes outward. A contact wall 76 of a second shield shell 70 (explained below) can contact the forward-stop wall 54 from the rear.

The second housing 50 has a front portion relative to the forward-stop wall 54. This portion is the second fitting portion 55. The second fitting portion 55 can be fitted in the first fitting portion 11 of the first housing 10. The second fitting portion 55 has an outer peripheral face having a front-end portion. A seal ring S2 is seated in this portion. Upon fitting of the second fitting portion 55 in the first fitting portion 11, the seal ring S2 intimately contacts the fitting seal face 15B to seal the gap. This prevents water from entering into the first fitting portion 11 from the fitting opening 15.

The second terminals 60 are elongated in the back-and-forth direction. A rear-end portion of each second terminals 60 is a crimping portion 62. While a wire harness W includes three wires 61 having the respective terminal portions, the crimping portions 62 are crimped onto the respective terminal portions. A front-end portion of each second terminal 60 is a second joint 63. The second fitting portion 55 has terminal-insertion holes 56 in a front wall thereof. Upon accommodation of the second terminals 60 in the cavities 52, the second joints 63 protrudes frontward from the terminal-insertion holes 56. When the first housing 10 and the second housing 50 are in the fitted state, the second joint 63 is superposed on a top face of the first joint 21 of the first terminal 20. Each second joint 63 has a second bolt-insertion hole 63A. The second bolt-insertion hole 63A is superposed on the top of the first bolt-insertion hole 21A. The second bolt-insertion hole 63A is substantially oval, a little elongated in the back-and-forth direction, and slightly larger than the first bolt-insertion hole 21A (see FIG. 8). In addition, each second terminal 60 has an engagement hole 64. The lance of the cavity 52 can be engaged with the engagement hole 64. Moreover, a rubber packing 65 is fitted on the wires 61, and thus the gap between the wire 61 and the cavity 52 is sealed.

The second housing 50 has guide ribs 58 (each of which corresponds to a guide in accordance with the present invention). The guide ribs 58 guide sliding of the second shield shell 70. Each guide rib 58 is disposed in respective one of a top face and a bottom face of the second housing 50. The guide rib 58 straightly extends from an area near a rear-end area to a foot of the forward-stop wall 54 (see FIG. 5). Both of the top and bottom guide ribs 58 are disposed in respective areas near a lateral end (the left side in FIG. 7) of the second housing 50.

The second housing 50 includes the second shield shell 70. The second shield shell 70 slides from the rear to be attached to the second housing 50. The second shield shell 70 is made by aluminium die-casting. The second shield shell 70 has a fastening portion 71 and a body 72 as integral parts thereof. The fastening portion 71 is fitted onto a substantial rear-half of the second housing 50. The body 72 is disposed in front of the fastening portion 71. Thus, when the first housing 10 and the second housing 50 are in the fitted state, the body 72 can cover a substantial front half (the second fitting portion 55) of the second housing 50 and the first fitting portion of the first housing 10. Specifically, the body 72 is substantially tubular and has a top plate 73, side plates 74, and a bottom plate 75. The top plate 73 covers an area including a top face of the second housing 50 and a top face of the first housing 10. The side plates 74 cover areas including two side faces of the second housing 50 and two side faces of the first housing 10. The bottom plate 75 covers a bottom face of a substantial front half (the second fitting portion 55) of the second housing 50.

In a front view of the second shield shell 70, the body 72 is laterally elongated and substantially rectangular, while the fastening portion 71 is laterally elongated, oval, and slightly smaller than the body 72. A back face of the body 72 is the contact wall 76 that can contact the forward-stop wall 54 of the second housing 50 from the rear.

Two sides of the body 72 have respective attachment portions 77. The attachment portions 77 extend laterally from end edge portions of the side plates 74 of the body 72 and then are bent frontward from the bottom end thereof. This bent portion is superposed on the screw hole (no illustrated in the drawings) of the case C and on the first screw-insertion hole 42 of the first shield shell 40. The bent portion has a second screw-insertion hole 78. The second screw-insertion hole 78 is superposed on the first screw-insertion hole 42. Thus, the second shield shell 70, the first shield shell 40, and the case C can be fixed with a single screw. Note that the level of the second screw-insertion hole 78 of one of the two attachment portions 77 (the left one in FIG. 6) is substantially equal to the level of the bottom plate 75 of the body 72. The level of the other one (the right one in the same figure) is upper than the level of the bottom plate 75 substantially by the thickness of the first shield shell 40.

A terminal portion of a shield member 66 is fitted on an outer peripheral face of the fastening portion 71. The shield member 66 is conductively fastened to the fastening portion 71 with a crimping ring 79. The shield member 66 and the wires 61 configure the wire harness W.

Furthermore, an inner peripheral face of the fastening portion 71 has concaved guide grooves 80 (each of which corresponds to a guide in accordance with the present invention). Each guide groove 80 has a shape to be engaged with the guide rib 58 of the second housing 50. Each of the guide grooves 80 is disposed in respective one of the top and the bottom of the fastening portion 71. The guide groove 80 straightly extends frontward from a rear end in a back-and-forth direction.

Fitting of the second housing 50 with the first housing 10 attached to the case C will hereinafter be explained. First, the second shield shell 70 is moved to the rear of the second housing 50, and the second housing 50 is fitted in the first housing 10. Then, the second joints 63 of the second terminals 60 reach the areas on the first joints 21 of the first terminals 20 disposed in the depth of the first fitting portion 11, and the second bolt-insertion holes 63A are superposed on the first bolt-insertion hole 21A. The second shield shell 70 is located in the rear, so that the operation hole 23 is uncovered and is opened. Bolts V are inserted into the first bolt-insertion hole 21A and into the second bolt-insertion hole 63A through the operation hole 23, are tightened into the nuts N1 of the wire-side bases 16, and thus are fixed. Thus, the first terminal 20 and the second terminal 60 are firmly pressure contacted and are conductively connected. That is, in addition to firm bolt connection between the apparatus-side terminals and the first terminals 20, firm bolt connection between the first terminals 20 and the second terminals 60 is realized. Thus, the connection reliability can be improved.

After the two terminals 20, 60 are bolted, the operation hole 23 is covered by the cap 30. As the stopper 32 of the cap 30 is being fitted into the operation hole 23, the two engagement pieces 35 run up the run-up faces 18A of the engagement protrusions 18 while elastically deforming outward. Then, on entire fitting of the stopper 32 of the cap 30 in the operation hole 23 and contacting of the lid 31 with the top face of the first fitting portion 11 at the same time, the engagement pieces 35 run over the engagement protrusions 18, elastically return, and are engaged with the engagement faces 18B of the engagement protrusions 18 so that the cap 30 is irremovably retained. Thus, because the cap 30 can be attached by the single operation, the attachment operation is easy to perform.

After attachment of the cap 30, the second shield shell 70 is slid frontward. Then, because the guide grooves 80 and the guide ribs 58 are in engagement with each other, the sliding is guided without causing misalignment of the second shield shell 70 relative to the second housing 50. Moreover, the guide grooves 80 and the guide ribs 58 prevent attachment of the second shield shell 70 upside down to the second housing 50.

Then, on contact of the contact wall 76 of the second shield shell 70 with the forward-stop wall 54 of the second housing 50, the front end portion of the second shield shell 70 covers the outer periphery of the back wall 43 of the first shield shell 40. Then, the back wall 43 of the first shield shell 40 and the body 72 of the second shield shell 70 entirely covers the first fitting portion 11 and the second fitting portion 55. Thus, the first housing 10 and the second housing 50 are put in an entirely covered state. Because only two members (the first shield shell 40 and the second shield shell 70) is needed to cover the two housings 10, 50, increase in parts count can be avoided.

At the same time, the second screw-insertion holes 78 reach the area where the screw holes of the case C and the first screw-insertion holes 42 have already been superposed. Note that one of the second screw-insertion holes 78 (the upper one in FIG. 8) is placed on a top of the first screw-insertion hole 42, while the other second screw-insertion hole 78 (the lower one in the same figure) is placed on a bottom of the first screw-insertion hole 42. Then, a screw (not illustrated in the drawings) is inserted into the layer of the first screw-insertion hole 42 and the second screw-insertion hole 78 and is tightened into the screw hole of the case C. Then, the second shield shell 70 and the first shield shell 40 are conductively fixed to the case C. Note that the two rear first screw-insertion holes 42 (the right ones in FIG. 3) are fixed only to the case C.

Note here that, for example, in a case where (differently from this embodiment) a first shield shell and a second shield shell are separately fixed at respective two points, four cycles in total of screwing operation is needed at four points in total using four screws. On the contrary to this, fixing two members at a single point as in this embodiment makes it possible to fix two members at respective two points only by screwing at two points in total. Therefore, the number of the screws and the number of cycles of the screwing operation can be less.

Furthermore, each second bolt-insertion hole 63A is substantially oval and slightly larger and a little longer in the back-and-forth direction than the first bolt-insertion hole 21A. Therefore, even in a case of misalignment of the first joints 21 relative to the respective second joints 63, the two bolt-insertion holes 21A, 63A are superposed insofar as the misalignment is within a range for the dimension of the second bolt-insertion hole 63A. This makes it possible to suitably bolt the two terminals 20, 60. Note that the misalignment of the two terminals 20, 60 relative to each other tends to be caused in the fitting direction of the two housings 10, 50, and the second bolt-insertion hole 63A is elongated in this direction. The size of the second bolt-insertion hole 63A is thus practically minimum.

Furthermore, because the operation hole 23 has an enough size, a tool such as an impact wrench can be easily inserted through the operation hole 23 to tighten the bolt V. This makes it possible to easily perform the bolting operation.

As explained above, the first embodiment makes it possible to: hold the second shield shell 70 in the position to expose the operation hole 23; bolt the bolt-insertion holes 21A, 63A (of the first terminals 20 and the second terminals 60) superposed in the first fitting portion 11 (of the first housing 10); and, thereafter, slide the second shield shell 70 to the position to cover the operation hole 23 and then fix the second shield shell 70 to the first shield shell 40. Thus, in addition to firm bolt connection between the apparatus-side terminals and the first terminals 20, firm bolt connection between the first terminals 20 and the second terminals 60 is realized. This makes it possible to improve the connection reliability.

<Second Embodiment>

Next, the connector for use with apparatus of a second embodiment in accordance with the present invention will be explained with reference to FIGS. 10 through 16.

The connector for use with apparatus of this embodiment has a first shield shell 110 and a second shield shell 120 that are different in the shapes from those of the first embodiment. Configurations similar to the first embodiment will be designated by identical reference characters, while repetitive explanation will be omitted. Further, in the second embodiment, portions of each component will hereinafter be designated as follows: the portion nearer the fitting faces of the two housings 100, 50 as the front; the top in FIG. 10 as the top; and the bottom in the same figure as the bottom.

Similar to the first embodiment, the first housing 100 and the second housing 50 of the connector for use with apparatus of this embodiment can be fitted together and removed from each other. The first shield shell 110 is attached to the first housing 100. The first shield shell 110 can be fixed to the case C.

The first housing 100, which is made of synthetic resin, includes a first fitting portion 101, a flange 102, and an apparatus-side fitting portion 103. The first fitting portion 101 is laterally elongated and substantially rectangular parallelepiped. The flange 102 is plate-like and extends from a circumference of a rear end portion of the first fitting portion 101. The apparatus-side fitting portion 103 protrudes rearward from a back face of the flange 102.

The first housing 100 can be attached to the attachment hole H with the first fitting portion 101 protruded to the outside of the case C and with the apparatus-side fitting portion 103 accommodated inside the case C. The flange 102 is disposed along the outer face of the case C then. A seal member 106 is seated on a back face of the flange 102. Upon intimate contact with the outer face of the case C, the seal member 106 seals the gap between a peripheral edge portion of the attachment hole H and the first housing 100.

Figure 11:
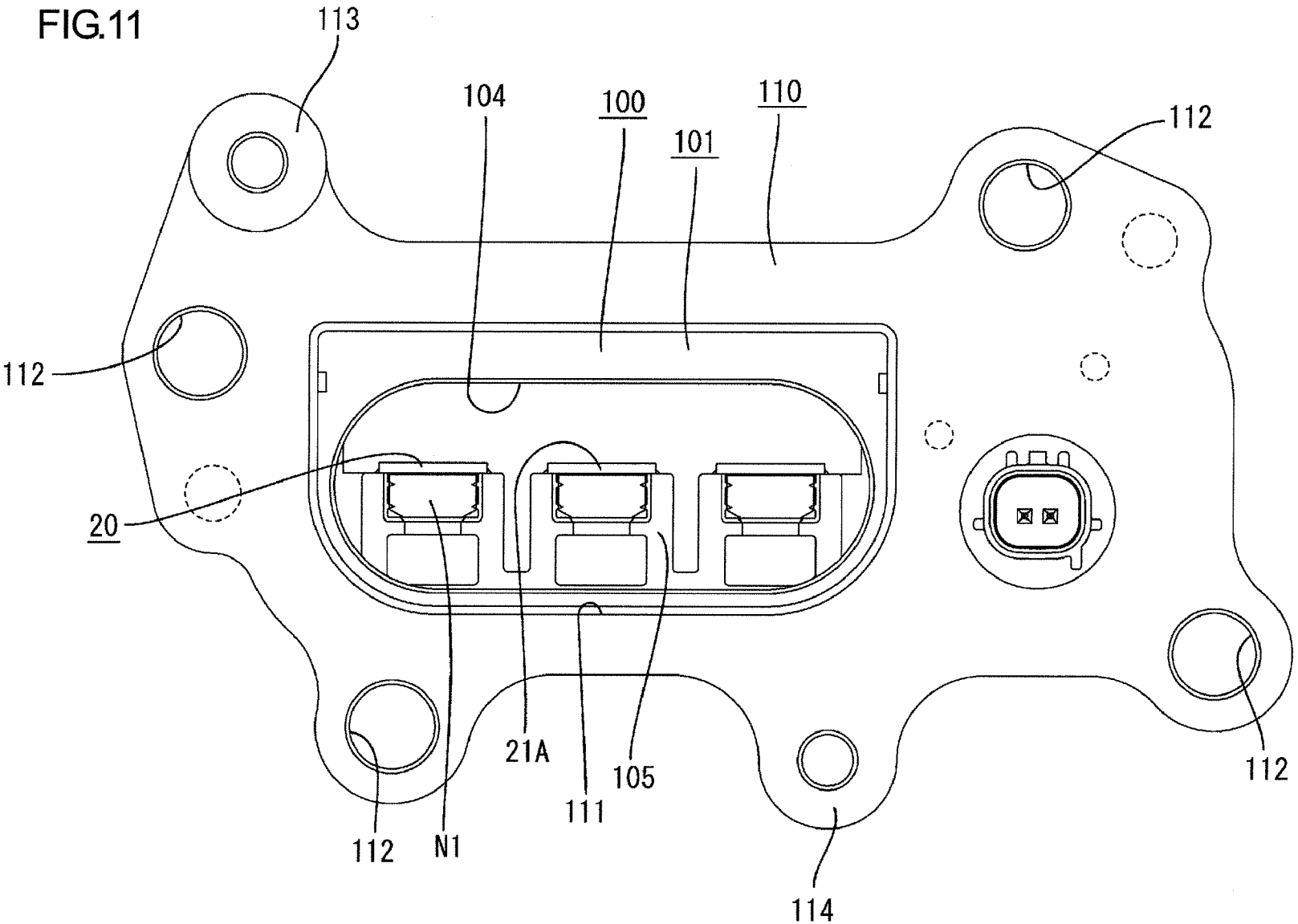
FIG. 11 is a front view of a first housing with a first shield shell attached thereto.
Figure 12:
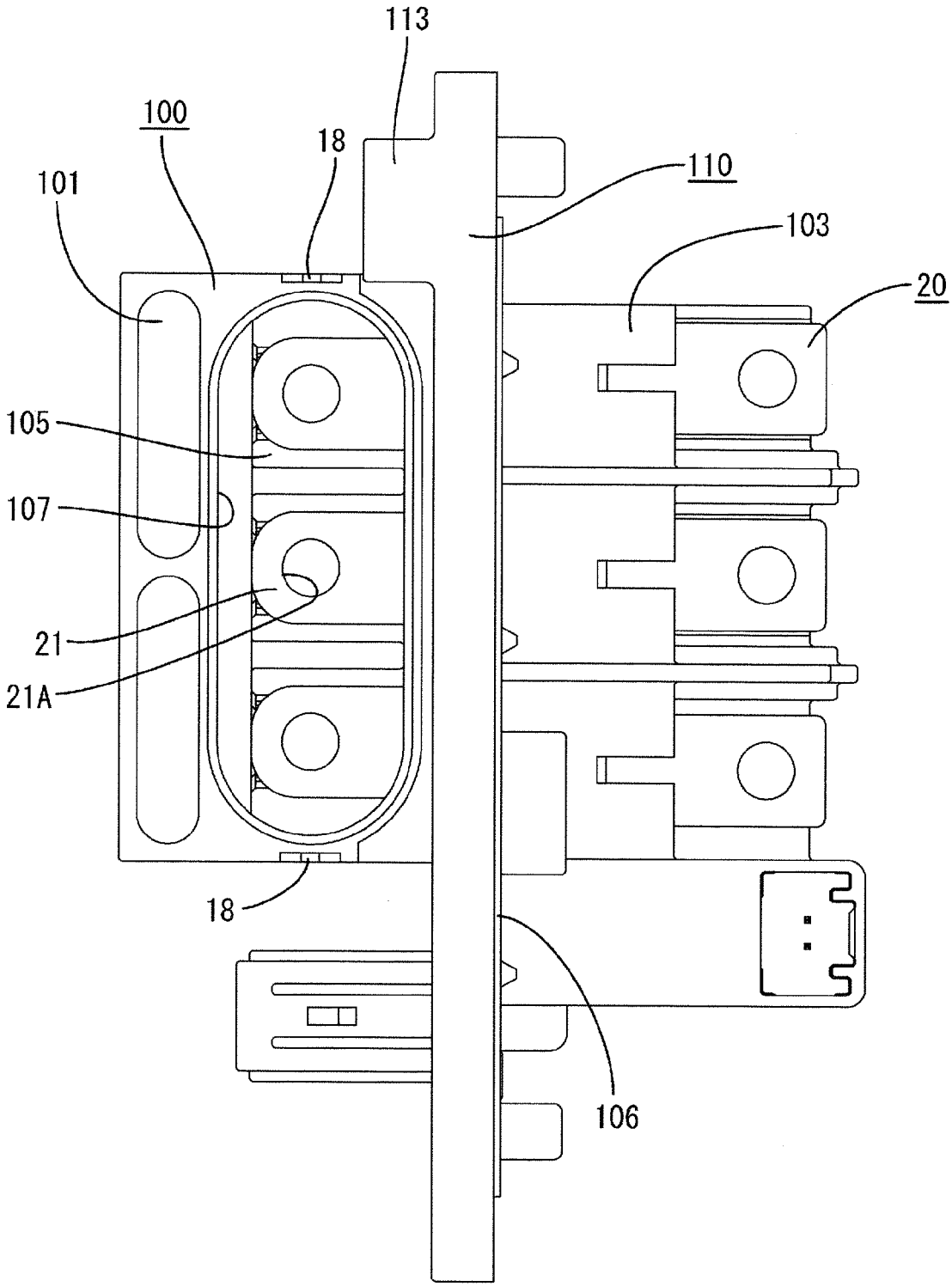
FIG. 12 is a plan view of the same.
Figure 13:
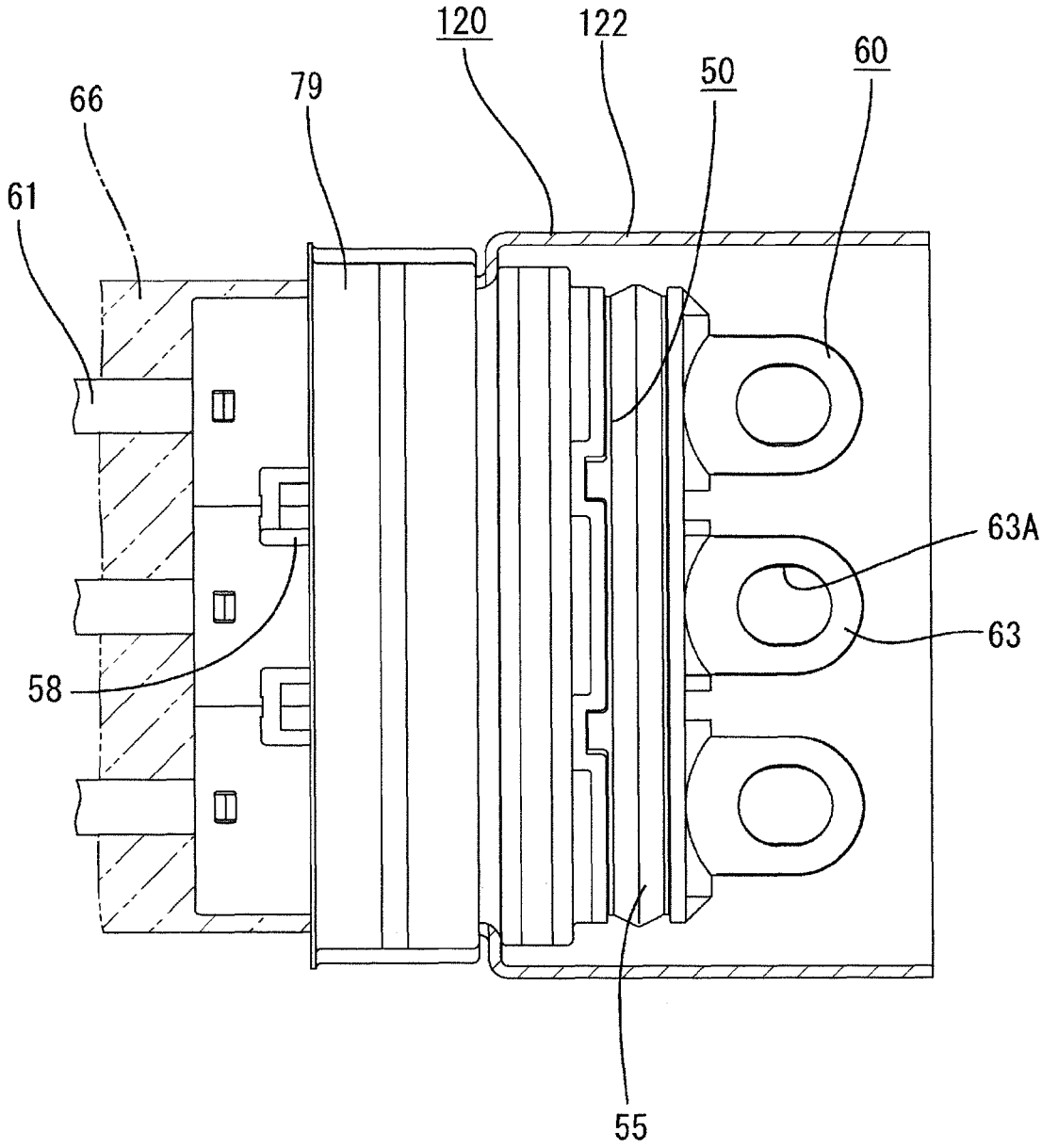
FIG. 13 is a plan sectional view of the second housing with a second shield shell attached thereto.
Figure 14:
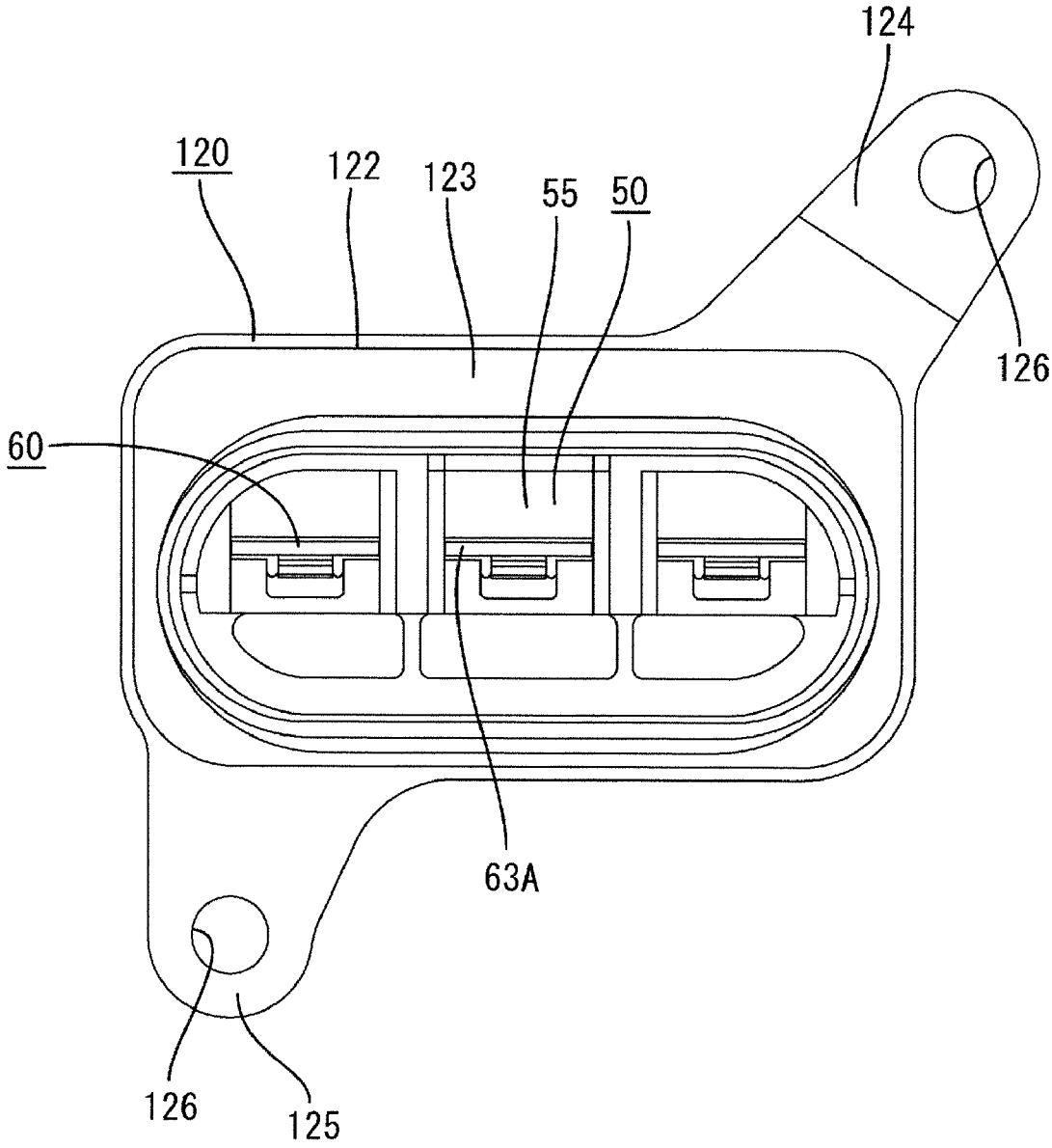
FIG. 14 is a front view of the same.
Figure 15:
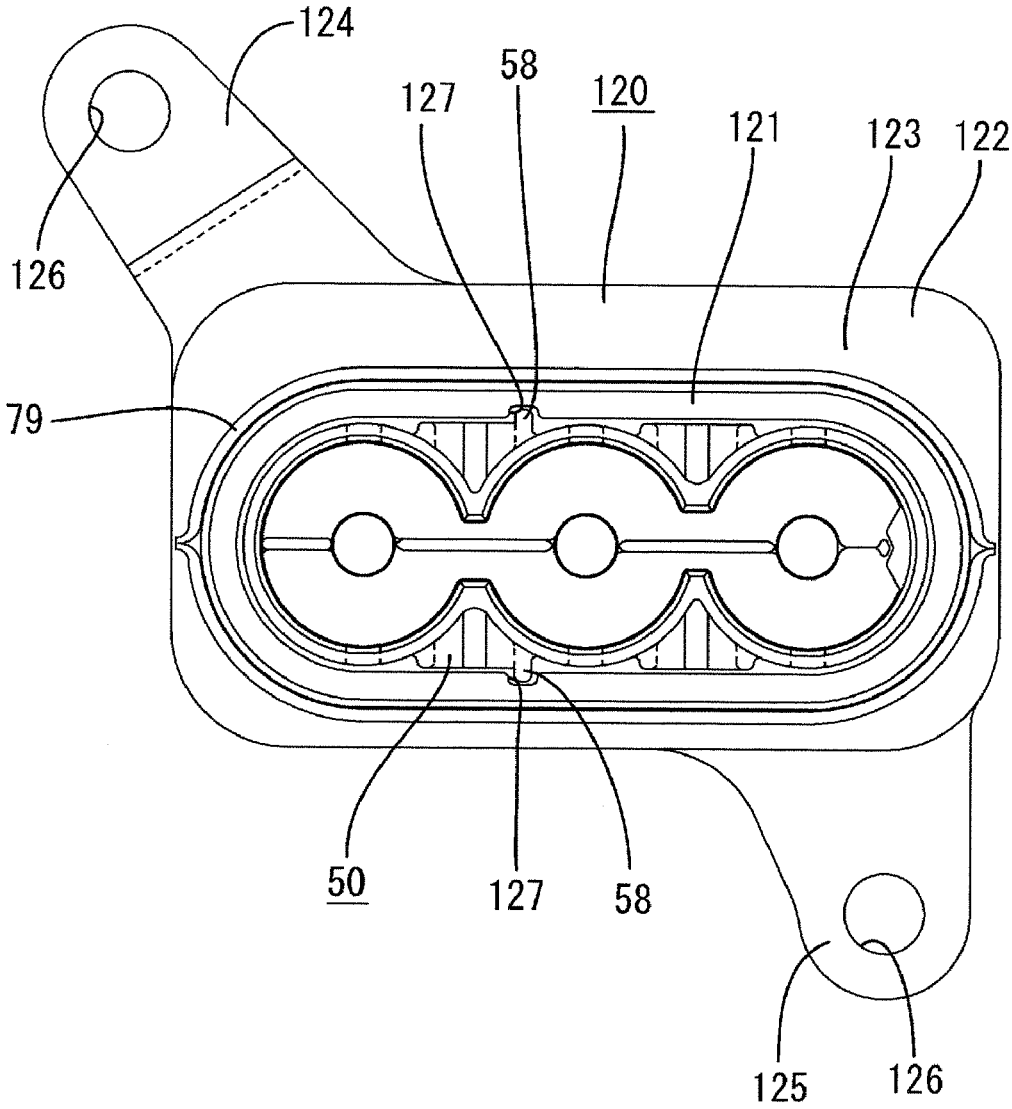
FIG. 15 is a rear view of the same.
Figure 16:
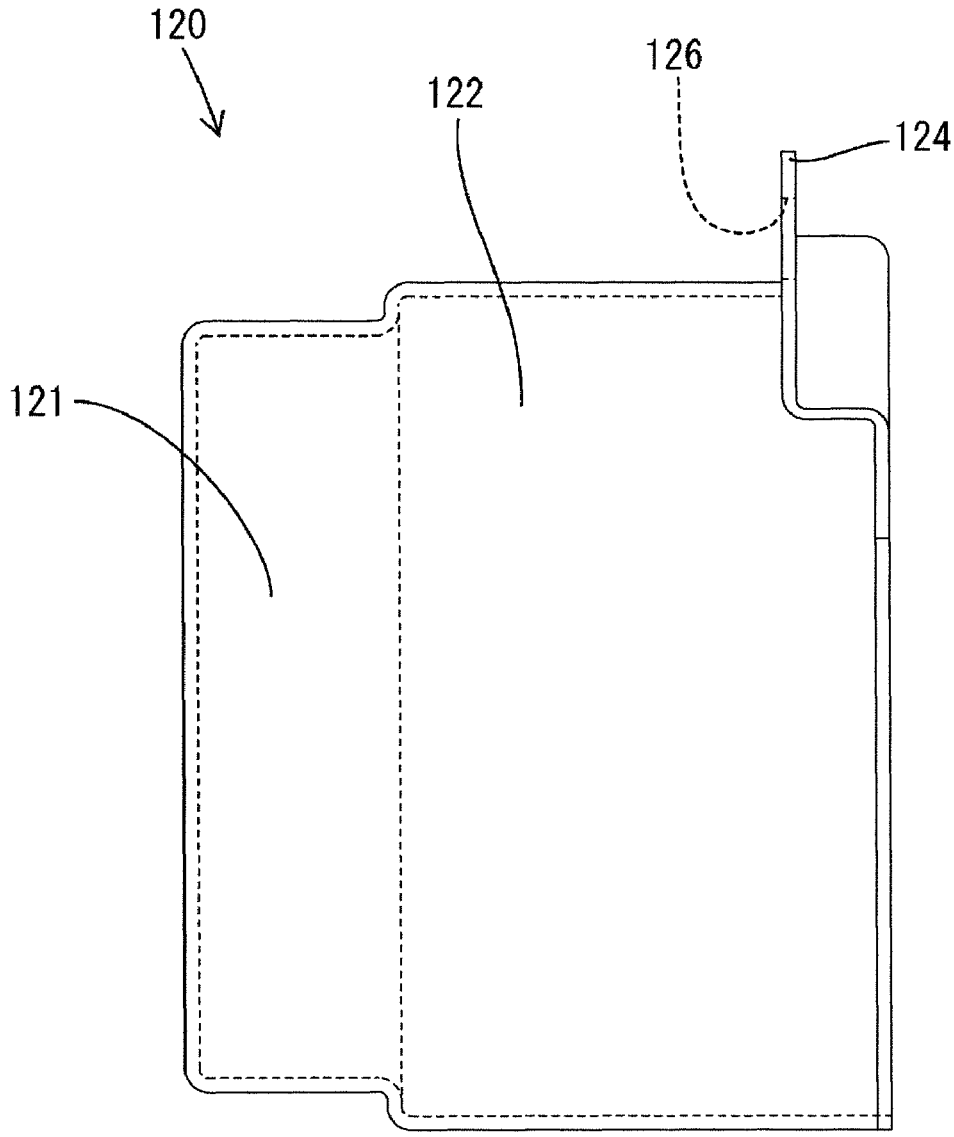
FIG. 16 is a plan view of the second shield shell.

The first fitting portion 101 has a substantially box-like shape with an inner hollow. A front wall of the first fitting portion 101 has a fitting opening 104. As illustrated in FIG. 11, the fitting opening 104 is laterally elongated and oval and extends in the back-and-forth direction. Thus, the inner space of the first fitting portion 101 is opened frontward. Besides, the first fitting portion 101 has three wire-side bases 105 arranged therein. The nuts N1 are disposed in the wire-side bases 105.

A top wall of the first fitting portion 101 has an operation hole 107. The operation hole 107 is disposed right above the wire-side bases 105. The operation hole 107 has a shape similar to that of the first embodiment.

The first shield shell 110 is attached to the first housing 100. The first shield shell 110 is made by aluminium die-casting. The first shield shell 110 has a shape to cover a front face and an entire peripheral face of the flange 102. A substantially center portion of the first shield shell 110 is a fitting opening 111. The fitting opening 111 fits a profile of the first fitting portion 101. In other words, the first shield shell 110 is disposed rearwardly relative to the first fitting portion 101 and protrudes outward (substantially perpendicularly to the fitting direction) from the circumference of the first fitting portion 101. The first shield shell 110 in a front view is laterally elongated and substantially rectangular. The fitting opening 111 is disposed a little off (to the left in FIG. 11) laterally from the widthwise center of the first shield shell 110.

The first shield shell 110 has first screw-insertion holes 112 in four corners (areas corresponding to the screw holes of the case C) thereof. The first screw-insertion holes 112 are superposed on the screw holes (not illustrated in the drawings) of the case C and then are screwed up, and thus the first shield shell 110 is conductively fixed to the case C. The flange 102 is held between the outer face of the case C and the first shield shell 110 and is shielded then.

The first shield shell 110 has an upper screw-up portion 113 and a lower screw-up portion 114 in an upper corner portion (a left corner portion in FIG. 11) thereof and in a lower substantial middle portion thereof, respectively. The lower screw-up portion 114 is disposed below a right end of the fitting opening 111. Thus, the positional relationship between the upper screw-up portion 113 and the lower screw-up portion 114 is diagonal across the fitting opening 111. The upper screw-up portion 113 and the lower screw-up portion 114 protrude frontward and rearward, respectively. The upper and lower screw-up portions 113, 114 have respective screw holes in the back-and-forth direction.

The second housing 50 includes the second shield shell 120. The second shield shell 120 slides from the rear to be attached to the second housing 50. The second shield shell 120 is made by aluminium die-casting. The second shield shell 120 has a fastening portion 121 and a body 122 as integral parts thereof. The fastening portion 121 is fitted on a substantial rear half of the second housing 50. The body 122 is disposed in front of the fastening portion 121 and is substantially tubular. Thus, when the first housing 100 and the second housing 50 are in the fitted state, the body 122 can entirely cover an area including the first fitting portion 101 of the first housing 100 and a substantial front half (the second fitting portion 55) of the second housing 50.

The second shield shell 120 in a front view is laterally elongated and substantially rectangular. The fastening portion 121 in a front view is laterally elongated, oval, and slightly smaller than the body 122. A back face of the body 122 is a contact wall 123. The contact wall 123 can contact the forward-stop wall 54 of the second housing 50 from the rear.

A top and a bottom faces of the body 122 have an upper and a lower attachment portions 124, 125, respectively. The attachment portions 124, 125 extend upward and downward, respectively, from a front end of the body 122. An extending end portion of each attachment portion 124, 125 has a second screw-insertion hole 126. The upper attachment portion 124 stands upward from a front edge of the body 122, is bent rearward by a protruding dimension of the upper screw-up portion 113, and then is bent upward again. The lower attachment portion 125 hangs straightly downward from the front edge of the body 122 within an area not to protrude laterally from the body 122. Each of the second screw-insertion holes 126 of the upper and the lower attachment portions 124, 125 is superposed on respective one of the screw holes of the upper and lower screw-up portions 113, 114.

Similar to the first embodiment, the fastening portion 121 has an outer peripheral face, whereon the terminal portion of the shield member 66 is fitted. The shield member 66 is conductively fastened to the fastening portion 121 with the crimping ring 79. An inner peripheral face of the fastening portion 121 has guide grooves 127. The guide grooves 127 can be engaged with the guide ribs 58 on the rear-end portions of the second housing 50.

In this embodiment, similar to the first embodiment, the second shield shell 120 is moved rearward relative to the second housing 50, and then, the second housing 50 is fitted in the first housing 100. Then, the bolt-insertion holes 21A, 63A can be bolted together. Thus, in addition to firm connection between the apparatus-side terminals and the first terminals 20, firm connection between the first terminals 20 and the second terminals 60 can be realized. Thus, the connection reliability can be improved.

After the terminals 20, 60 are bolted up into a connected state, the second shield shell 120 is slid frontward. The guide grooves 127 and the guide ribs 58 engaged together guide the sliding of the second shield shell 120. Then, on contact of the contact wall 123 of the second shield shell 120 with the forward-stop wall 54 of the second housing 50, the front end of the second shield shell 120 contacts a front face of the first shield shell 110, and the first shield shell 110 and the body 122 of the second shield shell 120 entirely cover and shield the first fitting portion 101 and the second fitting portion 55. At the same time, the second screw-insertion holes 126 of the second shield shell 120 are superposed on the front face of the respective upper and lower screw-up portions 113, 114. Thereafter, the screws (not illustrated in the drawings) are inserted into the second screw-insertion holes 126 and are screwed into the screw holes of the upper and lower screw-up portions 113, 114. Thus, the second shield shell 120 is conductively fixed to the first shield shell 110.

As explained above, in this embodiment, the front end of the second shield shell 120 contacts the front face of the first shield shell 110 so that the first fitting portion 101 and the second fitting portion 55 are covered. Therefore, a back wall of the first shield shell as of the first embodiment is not needed. This makes it possible to simplify the structure of the first shield shell 110.

Moreover, the first shield shell 110 has the upper and lower screw-up portions 113, 114 that are separate from the first screw-insertion holes 112. While the first screw-insertion holes 112 is for fixing the first shield shell 110 onto the case C, the upper and lower screw-up portions 113, 114 are for fixing the second shield shell 120. Note here that, without such screw-up portions 113, 114, the attachment portions of the second shield shell 120 would have to extend to the four corners of the first shield shell 110 (to positions corresponding to the screw holes of the case C). This would intricate the shape of the attachment portions. On the contrary, in this embodiment, the screw-up portions 113, 114 can be located in any areas in accordance with the shapes of the attachment portions 124, 125 of the second shield shell 120. Therefore, an intricate shape of the attachment portions 124, 125 can be avoided.

<Other Embodiments>

The present invention is not limited to the embodiments explained with reference to the drawings. For example, the following embodiments are also included within the scope of the present invention.

(1) In the above-explained embodiments, the second fitting portion 55 is fitted in the first fitting portion 11 (101). The present invention is not limited to this. For example, the second fitting portion may include a food portion to be fitted onto the first fitting portion. Then, in a case where the first fitting portion and the second fitting portion are superposed together, the operation hole will extend through both fitting portions to open them.

(2) In the above-explained embodiments, each second bolt-insertion hole 63A is substantially oval and slightly larger and a little more elongated in the back-and-forth direction than the first bolt-insertion hole 21A. The second bolt-insertion hole may have a same size with the first bolt-insertion hole. Likewise, the first bolt-insertion hole may be larger than the second bolt-insertion hole.

(3) In the above-explained embodiments, the cap 30 that stops the operation hole 23 (107) is included. The cap does not have to be necessarily provided.

(4) In the above-explained embodiments, the cap 30 includes the seal ring S1. The cap 30 does not have to necessarily include the seal ring.

(5) In the above-explained embodiments, the cap 30 has the engagement pieces 35, while the first fitting portion 11 (101) has the engagement protrusions 18. The cap and the first fitting portion may have any engagement structure.

(6) In the above-explained embodiments, the second housing 50 has the guide ribs 58, while the second shield shell 70 (120) has the guide grooves 80 (127). They do not have to be provided. Furthermore, the second housing and the second shield shell may have a guide grooves and a guide rib, respectively.

The invention claimed is:

1. A connector for use with apparatus and to be connected to a terminal of an apparatus accommodated in a metal case, the connector comprising:

a first housing that holds a first terminal that is bolt-connectable to the terminal of the apparatus, the first terminal having a first joint; and a second housing that holds a second terminal to be fastened to a terminal portion of an electric wire, the second terminal having a second joint, the second housing being capable of being fitted with the first housing to define a fitting portion, wherein:

the first joint of the first terminal and the second joint of the second terminal are superposed in the fitting portion and connectable together upon fitting the first housing with the second housing, the first and second joints having respective bolt-insertion holes that allow for insertion of a bolt therein so that the first and second joints are fixed together;

the fitting portion of the first and second housings has an operation hole that allows for bolting of the first and second joints;

a first shield shell is attached to the first housing, the first shield shell being fixable to the case;

a second shield shell is attached slidably to the second housing, for slidable movement relative to the second housing between: a first position where the operation hole is accessible from locations external of the second housing to permit insertion of the bolt or removal of the bolt; and a second position to cover the operation hole and to cooperate with the first shield shell to cover the fitting portion of the first and second housings when the second housing is fitted with the first housing.

2. The connector for use with apparatus according to claim 1, wherein:

the first shield shell is disposed rearwardly relative to the fitting portion of the first housing with the second housing in a fitting direction with the second housing and protrudes substantially perpendicularly to the fitting direction from a circumference of the fitting portion; and the second shield shell slides in a fitting direction of the two housings, the second shield shell having a front end portion in the fitting direction, the front end portion being contactable with the first shield shell.

3. The connector for use with apparatus according to claim 1, wherein:

the case has a screw hole for screw-fixing the first shield shell;

the first shield shell has an area corresponding to the screw hole of the case, the area having a first screw-insertion hole; and a screw inserted in the first screw-insertion hole is tightened into the screw hole of the case so that the first shield shell is fixed to the case.

4. The connector for use with apparatus according to claim 3, wherein:

the second shield shell has a second screw-insertion hole that is superposed on the screw hole of the case and on the first screw-insertion hole; and a screw inserted in the first screw-insertion hole and in the second screw-insertion hole is tightened up into the screw hole of the case so that the first shield shell and the second shield shell are fixed to the case.

5. The connector for use with apparatus according to claim 3, wherein:

the second shield shell has a second screw-insertion hole that allows for insertion of a screw thereinto, the screw being for fixing the second shield shell to the first shield shell; and the first shield shell has an area corresponding to the second insertion hole, the area having a screw-up portion wherein the screw is tightened and fixed.

6. The connector for use with apparatus according to claim 1, wherein:

the second housing and the second shield shell have respective guides, wherein the guides are engaged together to guide the sliding of the second shield shell.

7. The connector for use with apparatus according to claim 1, wherein:

the joint of the first terminal and the joint of the second terminal extend in the fitting direction of the two housings; and at least one of the bolt-insertion hole of the first terminal and the bolt-insertion hole of the second terminal is elongated in the fitting direction of the two housings.

8. A connector for use with apparatus and to be connected to a terminal of an apparatus accommodated in a metal case, the connector comprising:

a first housing that holds a first terminal that is bolt-connectable to the terminal of the apparatus, the first terminal having a first joint; and a second housing that holds a second terminal to be fastened to a terminal portion of an electric wire, the second terminal having a second joint, the second housing being capable of being fitted with the first housing to define a fitting portion, wherein:

the first joint of the first terminal and the second joint of the second terminal are superposed in the fitting portion and connectable together upon fitting the first housing with the second housing, the first and second joints having respective bolt-insertion holes that allow for insertion of a bolt thereinto so that the first and second joints are fixed together;

the fitting portion of the first and second housings has an operation hole that allows for bolting of the first and second joints;

a first shield shell is attached to the first housing, the first shield shell being fixable to the case;

a second shield shell is attached to the second housing, the second shield shell in a fitted state of the two housings being slidable between: a position to expose the operation hole to the outside; and a position to cover the operation hole and to cooperate with the first shield shell to cover the fitting portion of the two housings, and wherein:

the operation hole is capable of being covered by a cap; and the cap includes a seal ring that intimately contacts a peripheral face of the operation hole to seal the gap between the operation hole.

9. The connector for use with apparatus according to claim 8, wherein:

one of the cap and the fitting portion has an engagement piece;

the other one of the cap and the fitting portion has an engagement protrusion; and upon covering of the operation hole by the cap, the engagement piece and the engagement protrusion are engaged together to hold the cap in an attached state.

* * * * *